US005191882A

United States Patent [19]

Vogliano

[11] Patent Number: 5,191,882

[45] Date of Patent: Mar. 9, 1993

[54] APPARATUS FOR ENABLING A STRAPLESS BREATHING MASK TO BE WORN WITHOUT A PROTECTIVE HELMET

[75] Inventor: German Vogliano, Berlin, Fed. Rep. of Germany

[73] Assignee: Auergesellschaft GmbH, Berlin, Fed. Rep. of Germany

[21] Appl. No.: 667,879

[22] Filed: Mar. 12, 1991

Related U.S. Application Data

[63] Continuation-in-part of Ser. No. 480,738, Feb. 16, 1990, abandoned.

[30] Foreign Application Priority Data

Mar. 8, 1989 [DE] Fed. Rep. of Germany ..... 3907428

[51] Int. Cl.[5] ..... A62B 18/08

[52] U.S. Cl. ..... 128/207.11; 123/206.23

[58] Field of Search ..... 128/201.24, 206.27, 128/207.11, 201.22, 201.23, 201.25, 201.28, 201.29, 202.11, 206.23; 2/9, 428, 430

[56] References Cited

U.S. PATENT DOCUMENTS

| | | | |
|---|---|---|---|
| 2,312,630 | 3/1943 | Dauster | 128/207.11 |
| 2,375,147 | 5/1945 | Teague | 128/207.11 |
| 2,382,364 | 8/1945 | Yant | 2/428 |
| 2,827,900 | 3/1958 | Marietta | 128/207.11 |
| 3,043,299 | 7/1962 | Potash | 128/207.11 |
| 3,274,614 | 9/1966 | Boyer | 2/427 |
| 4,029,092 | 6/1977 | Morgan | 128/207.11 |
| 4,250,577 | 2/1981 | Smith | 2/427 |
| 4,352,353 | 10/1982 | Bolton et al. | 128/201.23 |
| 4,648,394 | 3/1987 | Wise | 128/201.24 |
| 4,653,124 | 3/1987 | McNeal et al. | 2/427 |
| 4,926,854 | 5/1990 | Bode | 128/201.23 |

FOREIGN PATENT DOCUMENTS

| | | | |
|---|---|---|---|
| 0236240 | 9/1987 | European Pat. Off. | 128/201.23 |
| 3122034 | 12/1982 | Fed. Rep. of Germany | 128/201.22 |

*Primary Examiner*—Edgar S. Burr
*Assistant Examiner*—Kimberly L. Asher
*Attorney, Agent, or Firm*—Reed Smith Shaw & McClay

[57] ABSTRACT

An apparatus for enabling a strapless breathing mask to be worn not only in conjunction with a protective helmet but also by itself without the helmet. The mask includes a strapless body, a window shield and a window frame, which can be disconnected from a protective helmet and, by way of the present apparatus, inserted into a resilient holder having a head strap assembly so that the breathing mask can be worn by a user without having to be connected to the protective helmet.

5 Claims, 6 Drawing Sheets

APPARATUS FOR ENABLING A STRAPLESS BREATHING MASK TO BE WORN WITHOUT A PROTECTIVE HELMET

This application is a continuation-in-part of pending U.S. patent application Ser. No. 07/480,738 filed Feb. 16, 1990 now abandoned.

FIELD OF THE INVENTION

The present invention relates to an apparatus for supporting a strapless breathing mask and more particularly to an apparatus for enabling a strapless breathing mask that is normally worn with a protective helmet to be worn without the protective helmet helmet.

BACKGROUND OF THE INVENTION

Strapless breathing masks consisting of a strapless valve body, a window frame and a window shield, are worn in conjunction with a protective helmet. The breathing mask is normally secured to the protective helmet by a plug-in type connection. A typical example of such a strapless breathing mask is provided in U.S. Pat. No. 4,926,854, the disclosure of which is incorporated herein by reference, which patent is assigned to the same assignee as the present invention. It would be desirable to provide a means by which strapless breathing masks, designed only for use with a protective helmet, could be adapted to be worn without the helmet.

SUMMARY OF THE INVENTION

Generally, the present invention relates to an apparatus for enabling a strapless breathing mask that is normally worn with a protective helmet to be worn without the protective helmet. A typical strapless breathing mask comprises a strapless body, a window frame and a window shield. The mask is specifically designed to be inserted into and secured to a protective helmet for use therewith. In the present invention, however, the mask can be removed from the helmet and inserted into a detachable resilient mask holder of the instant apparatus so that the breathing mask can be used without the helmet. The holder is preferably connected to an adjustable head strap assembly which allows the strapless breathing mask to be worn without being plugged into a protective helmet. The resilient holder can easily be removed from the strapless breathing mask if it is desired to reconnect the mask to a protective helmet.

Other details, objects and advantages of the present invention will be readily apparent from the following description of a presently preferred embodiment thereof.

BRIEF DESCRIPTION OF THE DRAWINGS

In the accompanying drawings, a preferred embodiment of the present invention is illustrated, by way of example only, wherein.

DESCRIPTION OF THE PREFERRED EMBODIMENT

Figure 1:
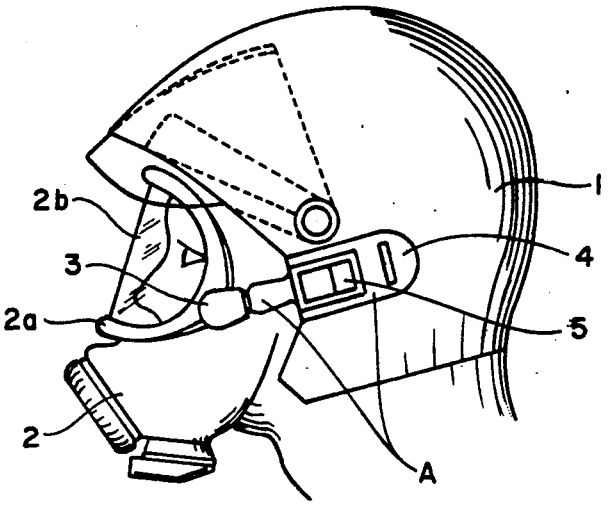
FIG. 1 is a side view of a protective helmet with a strapless breathing protection mask connected thereto in the condition as used by a wearer.
Figure 2:
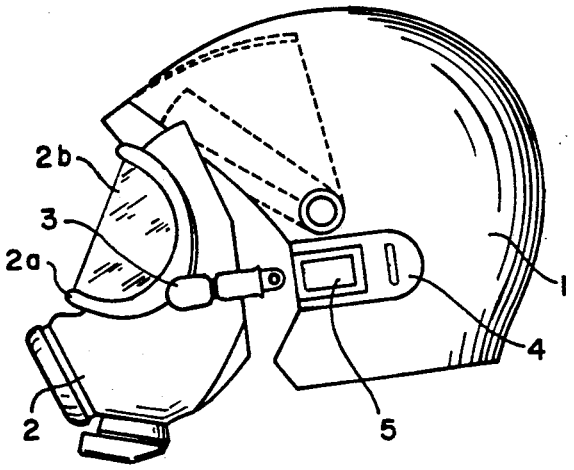
FIG. 2 is a side view of the protective helmet and the strapless breathing protection mask of FIG. 1 wherein the helmet and mask are separated from each other.

Referring to FIGS. 1 and 2, there is shown a protective helmet 1, worn by a user, with a strapless breathing protection mask 2 in position, where, arranged on either side of the mask 2, is a detachable connecting element A which provides connection between the protective helmet 1 and the breathing protection mask 2. The protective helmet 1 and breathing mask 2 are constructed generally in accordance with the protective helmet and breathing mask described in U.S. Pat. No. 4,926,854. Breathing mask 2 has a strapless body and can normally be used only in conjunction with protective helmet 1. The connecting element A essentially consists of two parts, namely of a plug part 3 mounted in articulated fashion on the breathing protection mask 2 at the window frame **2*a* of a looking glass or window shield 2*b*, and of a plug receptacle part 4 arranged on the protective helmet 1. The strapless body, window frame 2*a* and window shield 2*b*** of mask 2 are preferably integrally joined as a unit.

The release of the plug part 3 from the plug receptacle part 4 takes place by means of a spring-loaded key 5 which is carried by the plug receptacle part 4. The key 5 is provided with a suitable release mechanism such as, for example, the release mechanism disclosed in U.S. Pat. No. 4,926,854, the details of which are not critical to the present invention and, therefore, will not be further discussed herein, for enabling detachment of the mask 2 from the helmet 1.

Figure 3:
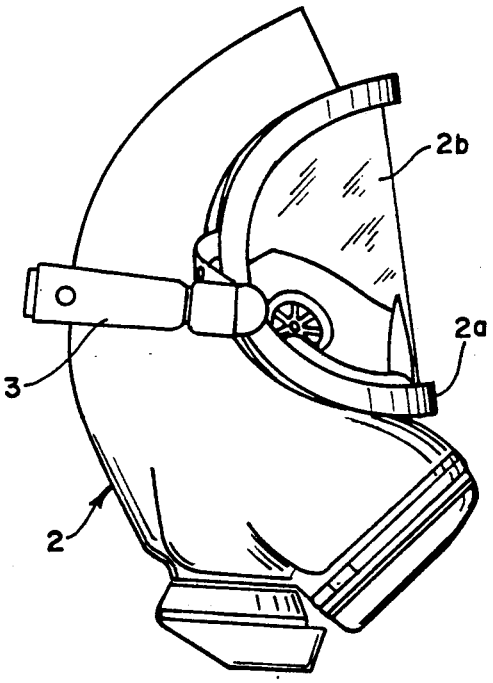
FIG. 3 is an enlarged view of the strapless breathing protection mask of FIGS. 1 and 2.
Figure 4:
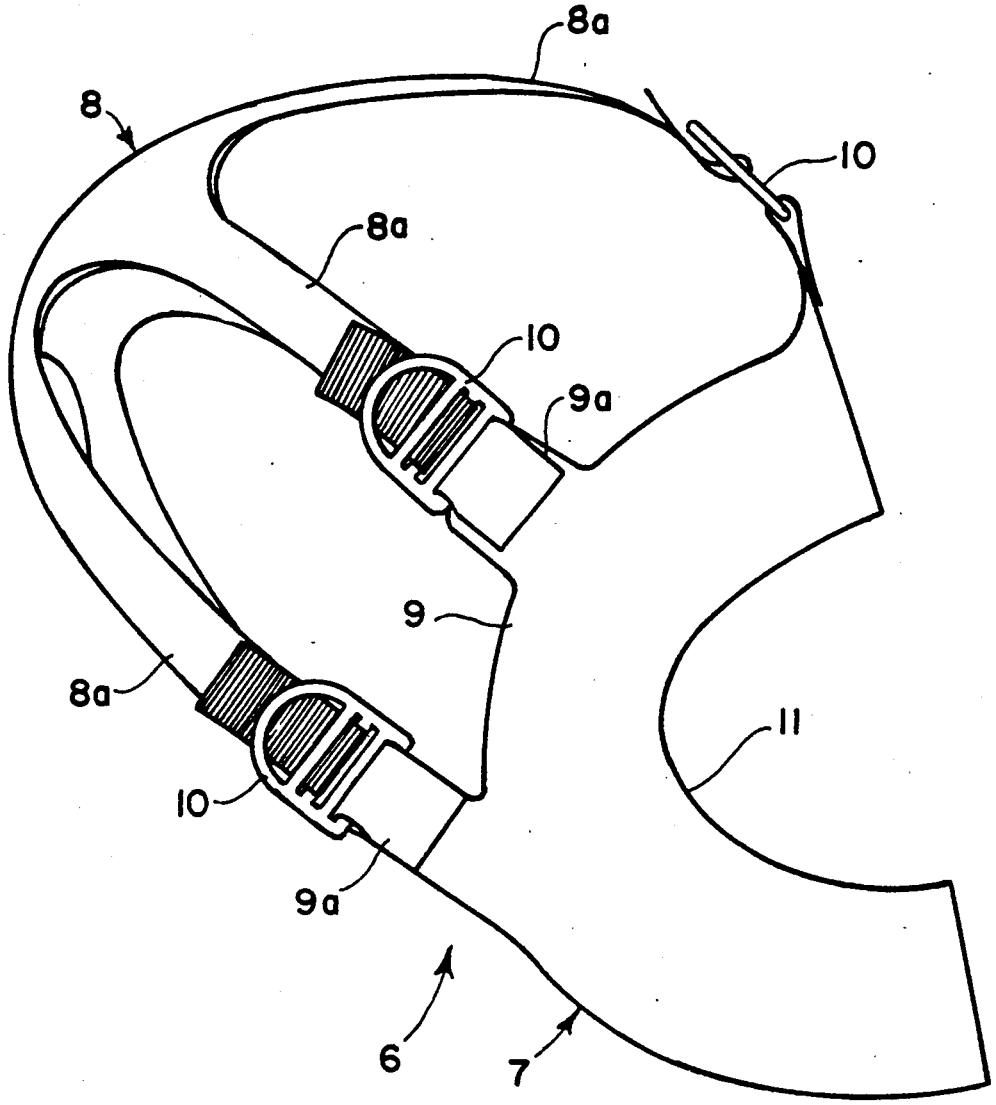
FIG. 4 is a side view of one embodiment of an apparatus according to the present invention for enabling a strapless breathing protection mask that is normally worn with a protective helmet to be worn without the protective helmet.
Figure 5:
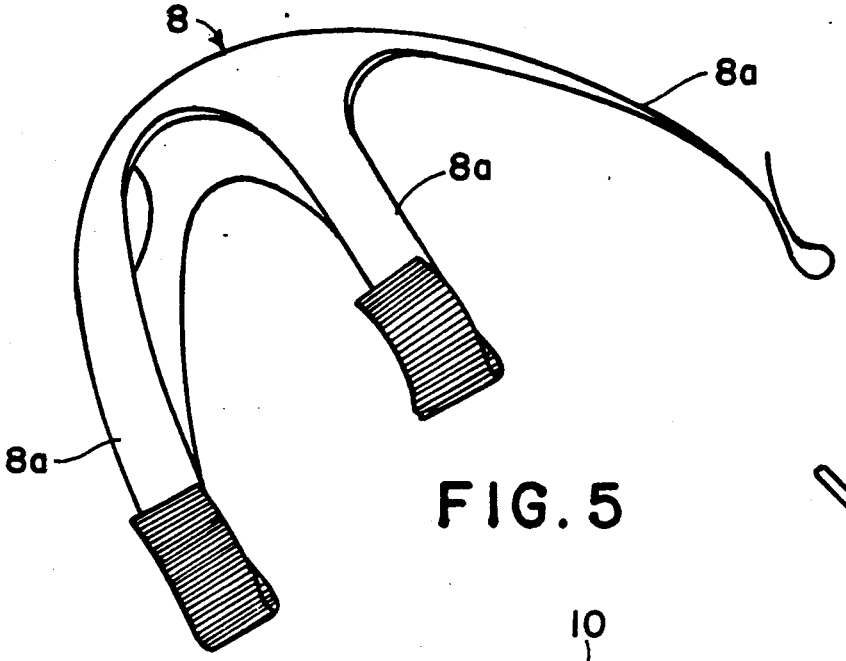
FIG. 5 is a perspective view of a head strap assembly which forms a part of the apparatus of the present invention.
Figure 6:
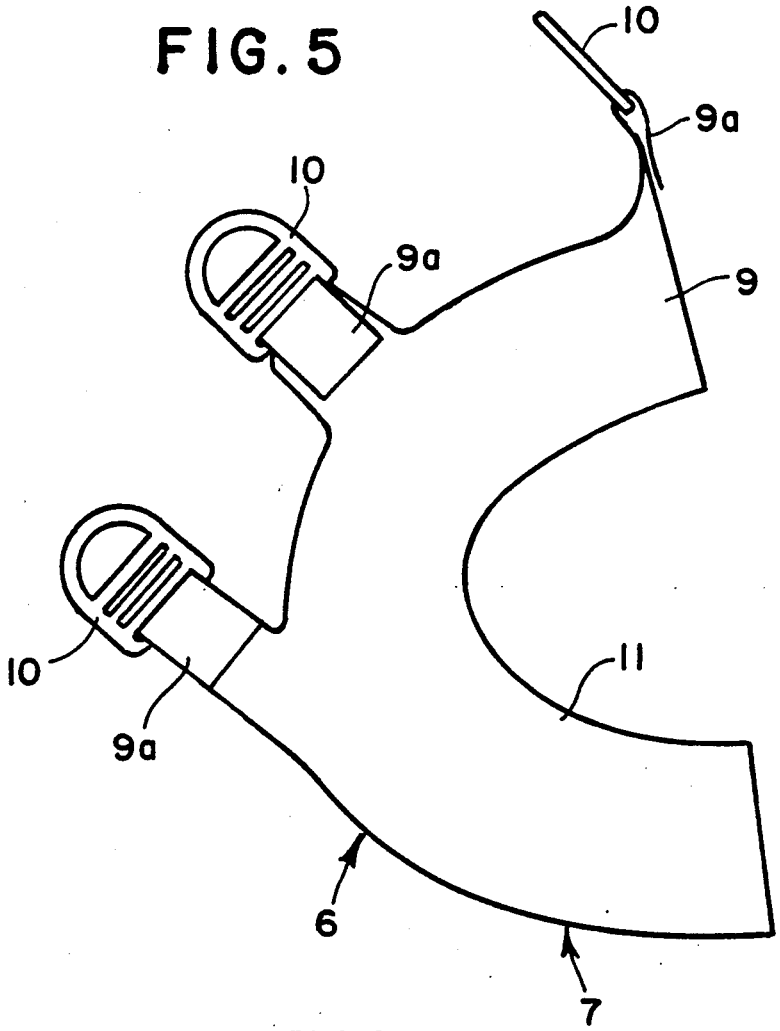
FIG. 6 is a side view of a breathing protection mask holder which forms another part of the apparatus of the present invention; r
Figure 7:
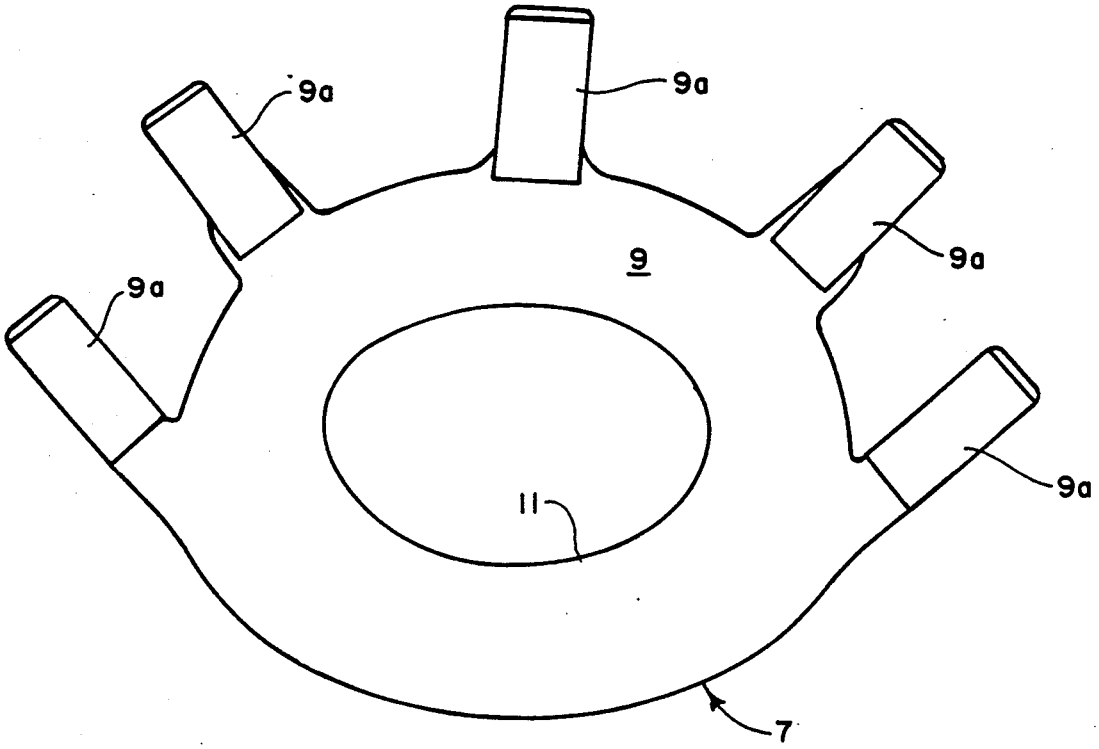
FIG. 7 is a front view of the breathing protection mask holder shown in FIG. 6.

An enlarged view of the strapless breathing protection mask 2 is shown in FIG. 3. The peripheral configuration of the window frame **2*a* and thus the window shield 2*b* is preferably substantially oval in shape and the preferred embodiment of the adaptor apparatus of the present invention to be described hereinbelow is constructed for particular usage with a strapless breathing mask having such a window shield configuration. It is to be understood, however, that the window shield of a typical breathing protection mask such as mask 2 may also comprise one or more window shield elements of different sizes and shapes than that shown in FIGS. 1–3**. Accordingly, it will become appreciated as the description of the preferred embodiment proceeds that the general concepts, design features and advantages of the illustrated preferred embodiment of the present invention may be suitably adapted and/or modified for use with breathing masks having window shields of virtually any conceivable configuration.

FIGS. 4, 5, 6 and 7 reveal the presently preferred embodiment of an adaptor apparatus 6 for enabling a strapless breathing protection mask (such as mask 2)

that can only be worn with a protective helmet (such as helmet 1) to be worn without the protective helmet. The apparatus 6 includes a first portion forming a resilient mask holder, herein designated by reference numeral 7 (see FIGS. 4, 6 and 7), and a second portion in the form of an adjustable head strap assembly 8 (see FIGS. 4 and 5) that is preferably detachably connectable to holder 7.

Figure 9:
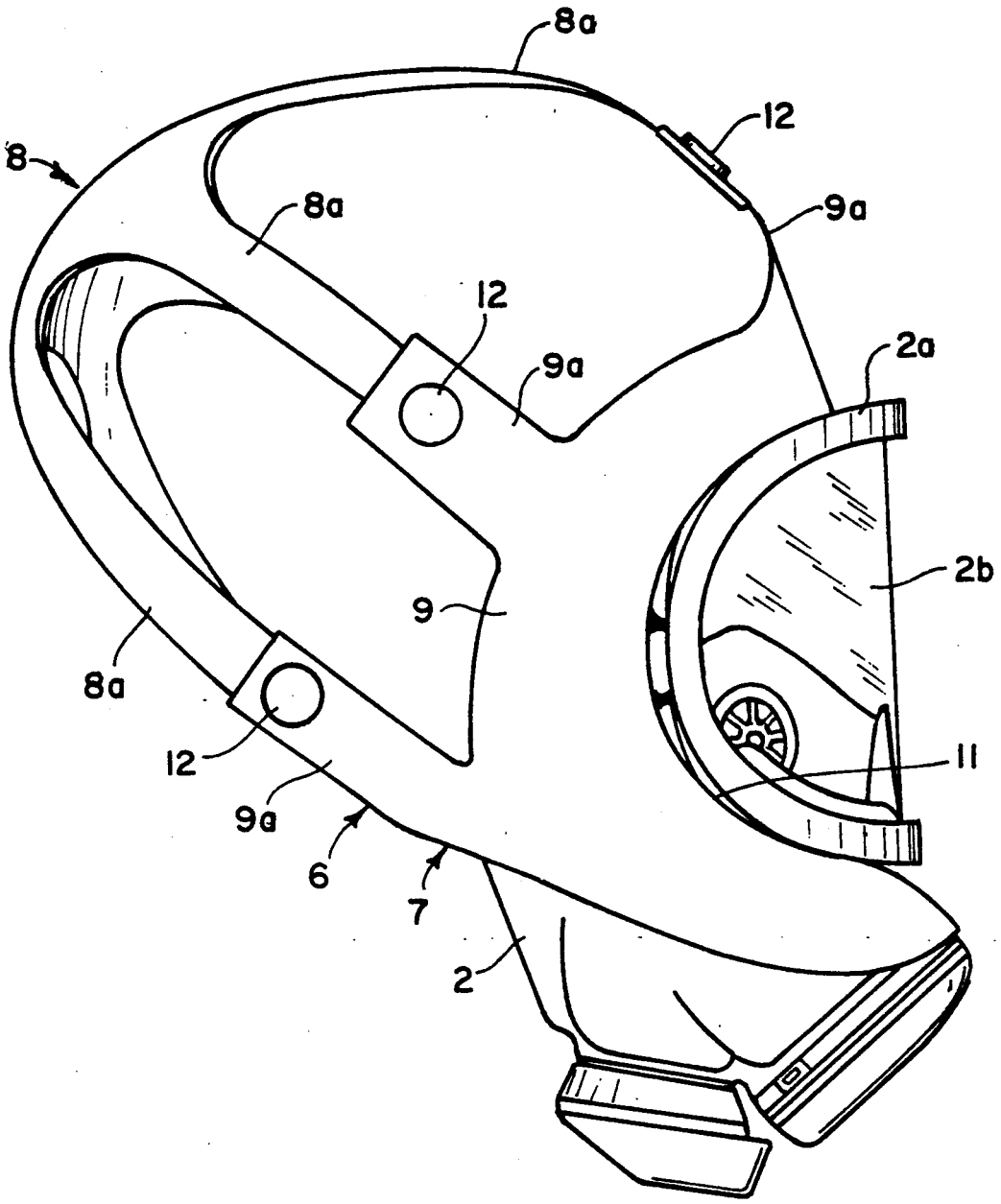
FIG. 9 is a view similar to FIG. 8 of a further embodiment of the present invention.

Preferably, the body of the holder 7 is formed of a resilient, conformable material such as rubber, or the like, a generally oval central portion 9 and a plurality of outwardly projecting web parts 9*a*. Although any number of web parts 9*a* which may sufficient to properly secure the holder 7 (and thereby the mask 2) to a user would be acceptable, it is preferred that there be five web parts 9*a* arranged as shown in the Figures. Head strap assembly 8 includes a plurality of straps 8*a* equal in number to web parts 9*a* which can be connected to the web parts 9*a* in a variety of ways including snap fasteners, buttons (as illustrated in FIG. 9), or other suitable means. Preferably, however, the straps 8*a* are connected to buckles 10 carried by the web parts 9*a* to permit adjustable connection of the head strap 8 and holder 7.

According to the preferred embodiment, central portion 9 has an opening 11 which generally corresponds to the shape of the window frame 2*a* of mask 2. It will be understood however, that if mask 2 is provided with a separate window shield 2*a* for each of the user's eyes then central portion 9 will preferably be provided with two openings substantially corresponding to the shape to the frames 2*b* of the two window shields.

Figure 8:
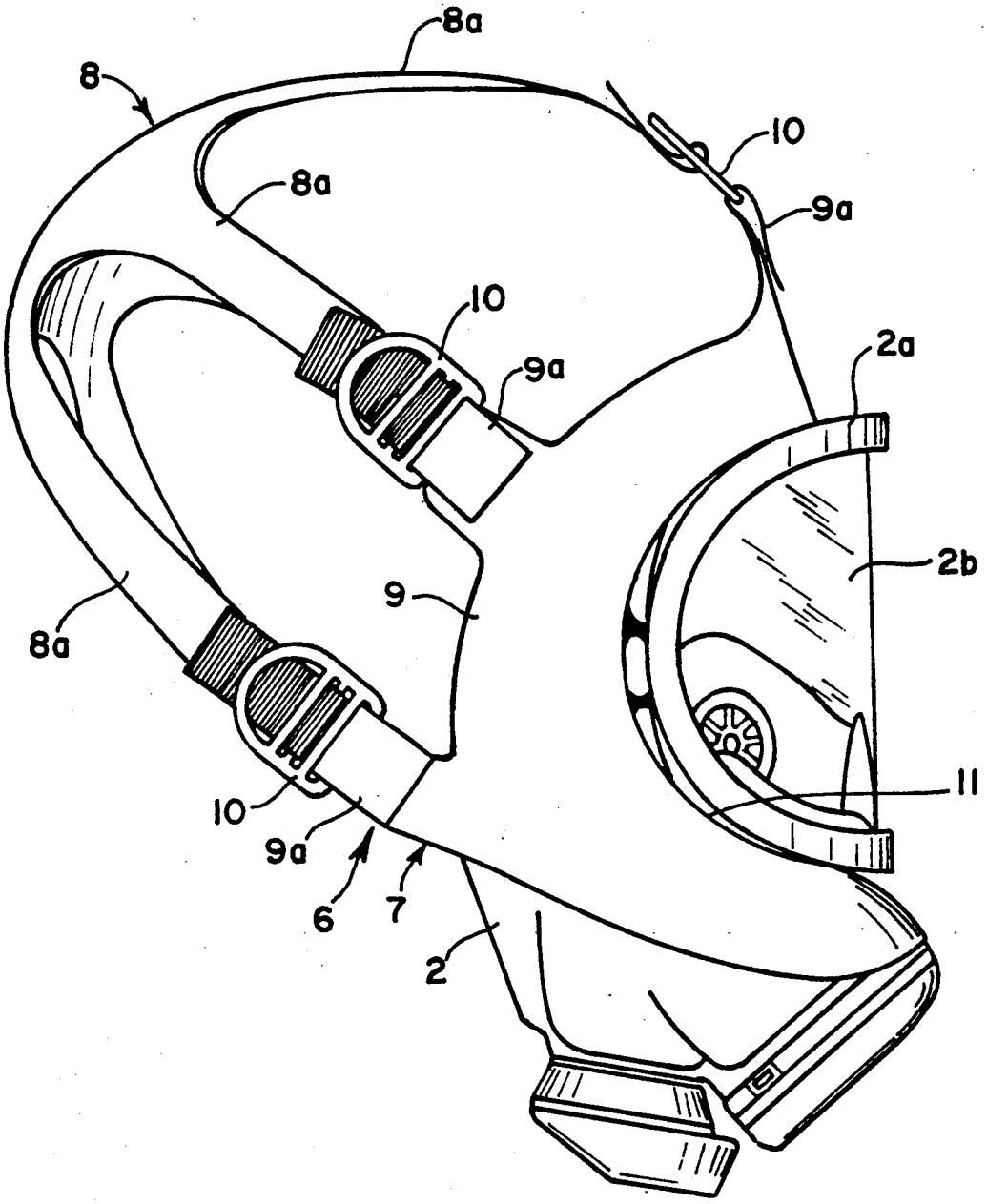
FIG. 8 is a side view of a strapless breathing protection mask supported in the apparatus of the present invention wherein the strapless breathing mask is capable of being worn without a protective helmet.

When the strapless breathing mask 2, which is normally connected to the protective helmet 1 as shown in FIG. 1, is to be worn without the helmet, the mask 2 is disconnected from the helmet and the window frame 2*a* of the mask is inserted into the opening 11 of the central portion 9 of holder 6 in the manner shown in FIG. 8. Opening 11 is preferably slightly smaller than the window frame 2*a* so that it is stretched about the periphery of and grippingly engages the window frame 2*a* to securely hold the mask 2 in holder 6. Once the mask 2 is properly inserted in the holder 6, the user places the head strap 8 over his head and the mask 2 over his face and adjusts straps 8*a* to obtain a tight seal between his face and the mask, whereupon the strapless breathing mask 2 may be effectively used without being attached to protective helmet 1. When it is desired to again use the mask 2 with helmet 1, the mask 2 is simply removed from resilient holder 6 and reconnected via plug part 3 to plug receptacle part 4.

FIG. 9 reveals a further embodiment of the invention wherein the head strap assembly 8 is secured to web portions 9*a* by buttons 12.

While presently preferred embodiments of practicing the invention have been shown and described with particularity in connection with the accompanying drawings, the invention may otherwise be embodied within the scope of the following claims.

What is claimed is:

1. An apparatus for enabling a strapless breathing mask including a strapless body, a window shield and a window frame, that is normally worn by a user in conjunction with a protective helmet, to be worn by the user without the protective helmet, the apparatus comprising:

a resilient holder having an opening through which the window frame of the mask is inserted and within which the mask is supported, wherein the opening corresponds substantially to the shape of the periphery of the window frame; and a head strap assembly connected to the resilient holder.

2. The apparatus as described in claim 1 wherein the holder comprises a substantially oval central portion formed of rubber and a plurality of web parts outwardly protecting from the central portion, the web parts being connected to the head strap assembly.

3. The apparatus as described in claim 2 wherein the head strap assembly is secured to at least one web part by an adjustable buckle.

4. The apparatus as described in claim 2 wherein the head strap is secured to at least one web part by a button.

5. The apparatus of claim 1 wherein the opening is slightly smaller than the periphery of the window frame.

* * * * *